US011821100B2

(12) United States Patent
Zhang et al.

(10) Patent No.: US 11,821,100 B2
(45) Date of Patent: Nov. 21, 2023

(54) CONDUCTIVE PLATING APPARATUS, PLATING SYSTEM AND PLATING METHOD FOR CONDUCTIVE FILM

(71) Applicant: XIAMEN HITHIUM ENERGY STORAGE TECHNOLOGY CO., LTD., Fujian (CN)

(72) Inventors: Wancai Zhang, Guangdong (CN); Junmin Feng, Guangdong (CN); Tingting Wu, Guangdong (CN)

(73) Assignee: XIAMEN HITHIUM ENERGY STORAGE TECHNOLOGY CO., LTD., Fujian (CN)

( * ) Notice: Subject to any disclaimer, the term of this patent is extended or adjusted under 35 U.S.C. 154(b) by 0 days.

(21) Appl. No.: 17/891,164

(22) Filed: Aug. 19, 2022

(65) Prior Publication Data

US 2023/0042419 A1 Feb. 9, 2023

Related U.S. Application Data

(63) Continuation of application No. PCT/CN2021/071608, filed on Jan. 13, 2021.

(30) Foreign Application Priority Data

Feb. 20, 2020 (CN) ..... 202010106535.2
Feb. 20, 2020 (CN) ..... 202020192756.1

(51) Int. Cl.
*C25D 7/06* (2006.01)
*C25D 17/00* (2006.01)

(52) U.S. Cl.
CPC ..... *C25D 7/0685* (2013.01); *C25D 7/0657* (2013.01); *C25D 17/005* (2013.01); *C25D 7/0621* (2013.01)

(58) Field of Classification Search
CPC ..... C25D 7/0614–0692
See application file for complete search history.

(56) References Cited

U.S. PATENT DOCUMENTS 7,045,043 B1 * 5/2006 Kim ..... C25D 3/02 204/279
2015/0211143 A1 7/2015 Nishimura et al.

FOREIGN PATENT DOCUMENTS

CN 1174249 A 2/1998
CN 2587889 Y 11/2003
(Continued)

OTHER PUBLICATIONS

Lu et al., Machine Translation & Original, CN 2587889 Y (Year: 2013).*

(Continued)

*Primary Examiner* — Hosung Chung

(57) ABSTRACT

Provided are a conductive plating apparatus, a plating system and a plating method for a conductive film. The conductive plating apparatus is configured to electrically connect the conductive film with a power supply. A first conductive structure includes a first conductive roller and a first press roller. A second conductive structure includes a second conductive roller and a second press roller. The first and second conductive structures are configured to allow the conductive film to sequentially pass between the first conductive roller and the first press roller and between the second the conductive roller and the second press roller. The first and second press rollers are configured to be brought into contact with and apply pressures to two opposite surfaces of the conductive film, respectively, and to be equipotential. The second press roller and the first conductive roller are configured to be equipotential.

12 Claims, 1 Drawing Sheet

(56) References Cited

FOREIGN PATENT DOCUMENTS

| | | | |
|---|---|---|---|
| CN | 1745609 | A | 3/2006 |
| CN | 105088298 | A | 11/2015 |
| CN | 106744028 | A | 5/2017 |
| CN | 106835225 | A | 6/2017 |
| CN | 108642549 | A | 10/2018 |
| CN | 211872119 | U | 11/2020 |

OTHER PUBLICATIONS

Guo et al., Machine Translation & Original, CN 208642549 A (Year: 2018).*

International Search Report dated Apr. 15, 2021 in International Application No. PCT/CN2021/071608. English translation attached.

* cited by examiner

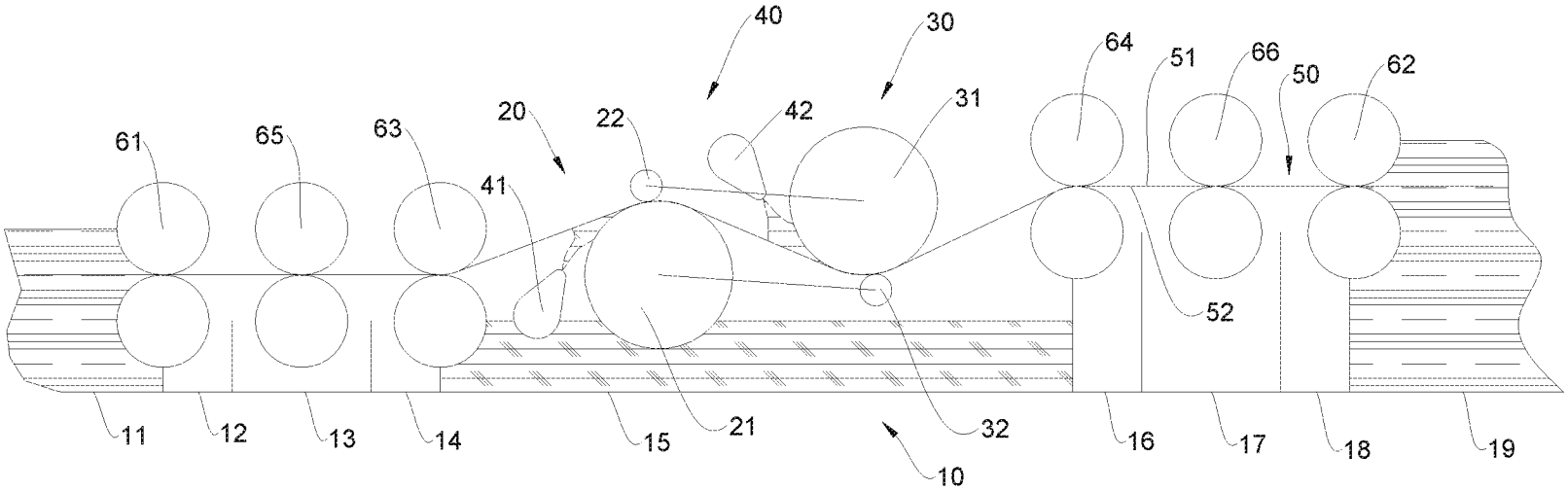
19
18
17
16
62
50
66
52
51
64
32
10
30
31
42
40
21
15
22
20
41
14
63
13
65
12
61
11

CONDUCTIVE PLATING APPARATUS, PLATING SYSTEM AND PLATING METHOD FOR CONDUCTIVE FILM

CROSS-REFERENCES TO RELATED APPLICATIONS

This application is a continuation of International Application No. PCT/CN2021/071608, filed on Jan. 13, 2021, which claims priority to Chinese Patent Application No. 202010106535.2, titled "CONDUCTIVE PLATING APPARATUS, PLATING SYSTEM AND PLATING METHOD FOR CONDUCTIVE FILM", and No. 202020192756.1, titled "CONDUCTIVE PLATING APPARATUS AND PLATING SYSTEM", filed with China National Intellectual Property Administration on Feb. 20, 2020, the entire disclosure of which is incorporated herein by reference.

FIELD

The present disclosure relates to the technical field of preparation of conductive thin films, and in particular, to a conductive plating apparatus, a plating system and a plating method for a conductive film.

BACKGROUND

Electroplating is a process of plating a thin layer of other metals or alloys on some conductive films using the principle of electrolysis, and is a process of attaching a layer of a metal film to a surface of a metal or other conductive material by electrolysis. It is possible to avoid a metal oxidation (such as rust), and can also improve wear resistance, electrical conductivity, light reflection, corrosion resistance, and can also increase aesthetics.

A typical conductive film may include a substrate film (a non-conductive polymer layer), and conductive layers attached to front and back surfaces of the polymer layer through PVD and CVD processes. However, the inventors have found that as the substrate film becomes thinner and the electroplated metal layer becomes thicker, the substrate film is more easily penetrated during the electroplating process.

SUMMARY

The purpose of the present disclosure is to provide a conductive plating apparatus, a plating system and a plating method for a conductive film, which can effectively reduce or even avoid a penetration of the conductive film during a plating process.

In a first aspect, an embodiment of the present disclosure provides a conductive plating apparatus configured to electrically connect a conductive film with a power supply. The conductive plating apparatus includes a first conductive structure and a second conductive structure. The first conductive structure includes a first conductive roller and a first press roller. The second conductive structure includes a second conductive roller and a second press roller. The first conductive structure and the second conductive structure are configured to allow the conductive film to sequentially pass between the first conductive roller and the first press roller and between the second conductive roller and the second press roller. The first press roller and the second press roller are configured to be brought into contact with and apply pressures to two opposite surfaces of the conductive film, respectively. The first press roller and the second conductive roller are configured to be equipotential. The second press roller and the first conductive roller are configured to be equipotential.

In this conductive plating apparatus, since the conductive film passes between the first conductive roller and the first press roller and between the second conductive roller and the second press roller, the first conductive roller and the second conductive roller are connected to negative electrodes of the power supply, respectively. Since the first press roller and the second press roller are brought into contact with and apply the pressure to the two opposite surfaces of the conductive film, respectively, the first press roller and the second press roller are brought into contact with and apply the pressures to the two opposite surfaces of the conductive film, respectively. That is, the first press roller is brought into contact with and applies the pressure to the first surface of the conductive film, and the second press roller is brought into contact with and applies the pressure to the second surface of the conductive film. Accordingly, the first conductive roller is in contact with and energizes the second surface of the conductive film, and the second conductive roller is in contact with and energizes the first surface of the conductive film. The first press roller and the second conductive roller are equipotential, and the second press roller and the first conductive roller are equipotential. The potentials between a position where the first surface of the conductive film is in contact with the first press roller and a position where the second surface of the conductive film is in contact with the first conductive roller are substantially equal, and the potentials between a position where the first surface of the conductive film is in contact with the second conductive roller and a position where the second surface of the conductive film is in contact with the second press roller are substantially equal. Therefore, it is possible to reduce a potential difference between the first surface and the second surface of the conductive film, thereby avoiding the conductive film from being penetrated during the plating process, so that better plating effect can be provided for the conductive film.

In one embodiment, the first conductive roller and the second press roller are electrically connected to each other, and the second conductive roller and the first press roller are electrically connected to each other. Optionally, the first conductive roller and the second press roller are electrically connected to each other by a wire, and the second conductive roller and the first press roller are electrically connected to each other by a wire. By means of electrical connection, the first press roller and the second conductive roller are equipotential, and the second press roller and the first conductive roller are equipotential, thereby reducing the potential difference between the first surface and the second surface of the conductive film.

In one embodiment, the first press roller is configured to be brought into contact with the first surface of the conductive film and apply a pressure to the first conductive roller, in such a manner that the first press roller and the first conductive roller are pressed against the conductive film. The second press roller is configured to be brought into contact with the second surface of the conductive film and apply a pressure to the second conductive roller, in such a manner that the second press roller and the second conductive roller are pressed against the conductive film.

The first press roller and the first conductive roller are brought into contact with the two opposite surfaces at a first position of the conductive film and are pressed against each other, respectively, and the second press roller and the second conductive roller are also brought into contact with the two opposite surfaces at a second position of the conductive film and are pressed against each other, respectively. By the first press roller and the second press roller, the conductive film is brought into better contact with the first conductive roller and the second conductive roller, so that better conductive effect can be provided between the conductive rollers and the conductive film, which can improve an overcurrent capability, and reduce the resistance, thereby reducing an amount of generated heat, so as to reduce the possibility of the penetration of the conductive film.

In one embodiment, the first conductive roller and the second conductive roller are configured in such a manner that the conductive film has an angle of contact when the conductive film is delivered, and the angle of contact is formed to increase the contact area between the first conductive roller and the second surface of the conductive film, and the contact area between the second conductive roller and the first surface of the conductive film, to a certain extent, which can provided better conductive effect between the conductive film and the conductive rollers, so as to reduce the possibility of the penetration of the conductive film.

In some embodiments of the present disclosure, the first press roller is located at a middle of the angle of contact on the first conductive roller, and the second press roller is located at a middle of the angle of contact on the second conductive roller, to further improve the contact effect between the conductive film and the conductive roller.

On the basis of increasing a contact area between the conductive film and the conductive rollers, better contact effect and better conductive effect can be provided between the conductive film and the conductive rollers, so as to reduce the possibility of the penetration of the conductive film.

In one embodiment, each of the first press roller and the second press roller is a rubber roller.

Each of the first press roller and the second press roller has a surface with a predetermined deformability. When the conductive film is rolled by the rubber rollers, the surface of the rubber roller may be formed as a concave-convex structure to match a small number of uneven parts on the surface of the conductive film, so that the pressure at any position of the conductive film is substantially the same, and thus better contact effect can be provided between the conductive film and the conductive roller, which can prevent the conductive film from being overheated and reduce the possibility of the penetration of the conductive film, and can also improve the wrinkling of the conductive film.

In one embodiment, a spray device is also included and configured to spray the conductive liquid to the conductive film that is being delivered or/and the conductive roller that is rotating, in such a manner that electric conduction between the conductive film and the respective conductive roller are capable of being electrically conductive by the sprayed conductive liquid.

The electricity can be conducted through the conductive liquid at a position where the contact effect between the conductive film and the conductive roller is poor, so that better conductive effect can be provided between the conductive film and the conductive roller. Thus, the overcurrent capability between the conductive film and the conductive roller is stronger, thereby preventing the conductive film from being penetrated due to being overheated. Meanwhile, since the conductive liquid has a predetermined cooling effect, the heated conductive film can be effectively cool down, so as to prevent the conductive film from being penetrated due to being heated.

In one embodiment, the spray device includes a first spray device and a second spray device. The first spray device is configured to spray the conductive liquid into a gap formed between the conductive film and the first conductive roller, and the second spray device is configured to spray the conductive liquid into a gap formed between the conductive film and the second conductive roller.

The conductive liquid may be sprayed at the gap formed between the first conductive roller and the second surface of the conductive film, and at the gap formed between the second conductive roller and the first surface of the conductive film. When the conductive film is brought into contact with the conductive rollers, there are conductive liquid on both the conductive film and the conductive rollers, thereby further increasing the conductive effect between the conductive film and the conductive rollers. In addition, the cooling effect is also better, which can improve the problem of the penetration of the conductive film.

In one embodiment, the first conductive structure and the second conductive structure are arranged sequentially in a delivering direction of the conductive film. The first spray device is located upstream of the first conductive roller, and the second spray device is located downstream of the first conductive roller and upstream of the second conductive roller.

After being sprayed first, the conductive film is brought into contact with the conductive rollers, so that the conductive liquid can provide its most role, so that better conductive effect can be provided between the conductive film and the conductive roller, and the conductive film can be cooled down first. Then, the conductive film is brought into contact with the press roller and the conductive rollers, to avoid the conductive film from being penetrated due to excessive temperature under the interaction force of the press roller and the conductive roller.

In one embodiment, a conductive liquid tank configured to contain the conductive liquid is further included, and the first conductive structure, the second conductive structure and the spray device are all located in the conductive liquid tank. In some embodiments of the present disclosure, both an axis of the first conductive roller and an axis of the second conductive roller are arranged substantially horizontally, and the axis of the first conductive roller is lower than the axis of the second conductive roller. The first conductive roller is at least partially immersed in the conductive liquid. Or in some embodiments of the present disclosure, the axis of the first conductive roller is higher than the axis of the second conductive roller, and the second conductive roller is at least partially immersed in the conductive liquid.

When the first conductive roller and the second conductive roller are arranged horizontally, the first conductive roller and the second conductive roller are staggered one above the other, and it is possible to effectively increase the angles of contact of the first conductive roller and the second conductive roller without increasing the diameters of the first conductive roller and the second conductive roller, so as to increase the conductive effect between the conductive film and the conductive rollers. Also, a lower part of the conductive roller is immersed into the conductive liquid. Since the conductive rollers are continuously rotated during the operation process, the lower part of the conductive roller in contact with the conductive liquid can be rotated to be positioned above the conductive roller. When the conductive film is brought into contact with the conductive roller, there is a predetermined amount of conductive liquid between the conductive film and the conductive roller, which can provide better conductive effect between the conductive film and the conductive roller, and can also cool the conductive roller, so as to cool the conductive film in contact with the conductive roller.

In a second aspect, embodiments of the present disclosure provide a plating system configured to form a first plating layer and a second plating layer on a conductive film. The plating system includes the conductive plating apparatus as described above and a plating tank configured to contain plating solution. The conductive plating apparatus is arranged outside the plating tank.

When this plating system plates the conductive film, since the potential difference between the first surface and the second surface of the conductive film is reduced by the conductive plating apparatus as described above, it is possible to prevent the conductive film from being penetrated during the plating process and provide better plating effect for the conductive film.

In one embodiment, the plating tank includes a first plating tank and a second plating tank. The first plating tank is located at a side of the first conductive structure away from the second conductive structure, and the second plating tank is located at a side of the second conductive structure away from the first conductive structure. In some embodiments of the present disclosure, the first plating tank is in communication with the second plating tank.

In one embodiment, a first separation structure for separating the first plating tank from the conductive liquid tank, and a second separation structure for separating the second plating tank from the conductive liquid tank are included. The first separation structure and the second separation structure are configured to partition the plating solution from the conductive liquid respectively to avoid mutual contamination.

In one embodiment, the first separation structure includes a first liquid separation tank and a second liquid separation tank that are both located between the first plating tank and the conductive liquid tank. The first liquid separation tank is close to the first plating tank. The second separation structure includes a third liquid separation tank and a fourth liquid separation tank that are both located between the second plating tank and the conductive liquid tank. The fourth liquid separation tank is close to the second plating tank. In some embodiments of the present disclosure, a first liquid recycling tank and a second liquid recycling tank are also included. The first liquid recycling tank is located between the first liquid separation tank and the second liquid separation tank, and the second liquid recycling tank is located between the third liquid separation tank and the fourth liquid separation tank. The plating solution and the conductive liquid may be better separated from each other by the first liquid separation tank, the first liquid recycling tank, the second liquid separation tank, the third liquid separation tank, the second liquid recycling tank, and the fourth liquid separation tank, so as to avoid mutual cross-contamination.

In one embodiment, a set of first liquid stopping rollers is arranged at an interface between the first plating tank and the first liquid separation tank, and a set of second liquid stopping rollers is arranged at an interface between the second plating tank and the fourth liquid separation tank. A set of third liquid stopping rollers is arranged at an interface between the conductive liquid tank and the second liquid separation tank, and a set of fourth liquid stopping rollers is arranged at an interface between the conductive liquid tank and the third liquid separation tank. A set of first liquid pressing rollers is arranged in the first liquid recycling tank, and a set of second liquid pressing rollers is arranged in the second liquid recycling tank. The plating solution can be further confined in the plating tank by the first liquid stopping roller and the second liquid stopping roller, and the conductive liquid may be further confined in the conductive tank by the third liquid stopping roller and the fourth liquid stopping roller. The conductive liquid or the plating solution on the conductive film can be removed by the first liquid pressing rollers and the second liquid pressing rollers to avoid mutual contamination of the conductive liquid and the plating solution. In a third aspect, embodiments of the present disclosure provide a plating method for a conductive film, which is applied in the plating system as described above. The plating method includes: controlling the conductive film to be brought into contact with the plating solution in the plating tank, and to pass between the first conductive roller and the first press roller and between the second conductive roller and the second press roller, in such a manner that the first press roller and the second press roller are brought into contact with two opposite surfaces of the conductive film respectively and apply pressures to the conductive film that is being delivered; providing equal potentials to the first press roller and the second conductive roller; providing equal potentials to the second press roller and the first conductive roller; and plating the conductive film.

The plating method can reduce the potential difference between the first surface and the second surface of the conductive film, thereby avoiding the conductive film from being penetrated during the plating process, and provide better plating effect for the conductive film.

In one embodiment, the plating method also includes: spraying conductive liquid onto the conductive film that is being delivered or/and the conductive roller that is rotating by a spray device; optionally, a temperature of the conductive liquid is lower than a plating temperature for the conductive film by 5° C. to 10° C.

After sprayed onto the conductive film or/and the conductive roller, the conductive liquid may have a certain cooling effect on the conductive film and the conductive roller. That is, the conductive liquid has a cooling effect on the contact surface of the conductive film and the conductive roller, which can improve the overcurrent capability from the conductive roller to the conductive film, thereby reducing the amount of the generated heat of the conductive film and improving the occurrence of the phenomenon that the conductive film is penetrated.

In one embodiment, the conductive film includes a non-conductive polymer layer and conductive layers arranged on two surfaces of the non-conductive polymer layer; optionally, the conductive film has a thickness ranging from 5 nm to 1000 nm.

The conductive film is an ultra-thin conductive film, and its ability to withstand current and voltage is relatively weak. Thus, the conductive film is easily penetrated during the electroplating. With the solution according to the embodiments of the present disclosure, it is possible to effectively prevent the conductive film from being penetrated during the plating process to obtain an ultra-thin film with high conductivity.

BRIEF DESCRIPTION OF DRAWINGS

In order to more clearly explain the technical solutions of the embodiments of the present disclosure, drawings used in the description of the embodiments are briefly described below. It should be understood that the drawings as described below merely illustrate some embodiments of the present disclosure, and therefore should not be regarded as a limitation of the scope. For those of ordinary skill in the art, based on these drawings, other drawings fallen within the scope of the present disclosure can be obtained without creative labor.

FIGURE is a schematic structural view of a plating system according to an embodiment of the present disclosure.

REFERENCE NUMERALS

10—tank; 20—first conductive structure; 30—second conductive structure; 40—spray device; 50—conductive film; 51—first surface; 52—second surface; 11—first plating tank; 12—first liquid separation tank; 13—first liquid recycling tank; 14—second liquid separation tank; 15—conductive liquid tank; 16—third liquid separation tank; 17—second liquid recycling tank; 18—four liquid separation tank; 19—second plating tank; 61—first liquid stopping roller; 62—second liquid stopping roller, 63—third liquid stopping roller; 64—fourth liquid stopping roller; 65—first liquid pressing roller; 66—second liquid pressing roller; 21—first conductive roller; 22—first press roller; 31—second conductive roller; 32—second press roller; 41—first spray device; 42—second spray device.

DESCRIPTION OF EMBODIMENTS

In order to make the purposes, technical solutions and advantages of the embodiments of the present disclosure clearer, the technical solutions in the embodiments of the present disclosure will be described below with reference to the accompanying drawings in the embodiments of the present disclosure.

In the related art, a conductive film is an ultra-thin film with a non-conductive polymer layer in a middle thereof and conductive layers being deposited on both surfaces thereof. In some embodiments of the present disclosure, the conductive film is an ultra-thin film of a thickness ranging from 5 nm to 1000 nm, and the conductive layer of the conductive film has a thickness ranging from 5 nm to 10 nm. During a plating process, the conductive film will be penetrated.

The inventor has found through research that, since the non-conductive polymer layer is arranged in the middle of the conductive film, and the conductive layer on the first surface and the conductive layer on the second surface of the conductive film cannot conduct electricity directly through the middle polymer layer, the first surface of the conductive film is connected to a negative electrode of a power supply by a first conductive roller, and the second surface of the conductive film (the first surface and the second surface are opposite surfaces of the conductive film) is connected to the negative electrode of the power supply by a second conductive roller. In order to obtain better conductive effect between the conductive roller and the conductive film, the conductive film may be formed with a predetermined angle of contact on the conductive roller. If the first conductive roller and the second conductive roller are arranged opposite to each other, i.e., the first conductive roller and the second conductive roller are in contact with two opposite surfaces of the conductive film at a same position, when an angle of contact is formed on the first conductive roller, it is unable to form an angle of contact on the second conductive roller, or when an angle of contact is formed on the second conductive roller, it is unable to form an angle of contact on the first conductive roller. Therefore, by staggering the first conductive roller with the second conductive roller, an angle of contact can be formed on both the first conductive roller and the second conductive roller.

Since the first conductive roller and the second conductive roller are connected to different negative electrodes of the power supply (these negative electrodes are a common ground), and the first conductive roller and the second conductive roller are staggered, a positive electrode of the power supply is connected to the negative electrode of the power supply from the first conductive roller after passing through the first surface of the conductive film, and is connected to the negative electrode of the power supply from the second conductive roller after passing through the second surface of the conductive film. As a result, due to difference in contacting positions of the first conductive roller and the second conductive roller with the conductive film, a current path on the first surface and a current path on the second surface are different, and a resistance value will have a certain difference, so that a potential difference is generated between the first surface and the second surface at the same position of the conductive film, which in turn results in the penetration of the conductive film during the plating process.

In order to solve the above problems, FIGURE is a schematic structural view of a plating system according to an embodiment of the present disclosure. Referring to the FIGURE, an embodiment of the present disclosure provides a plating system configured to form a first plating layer and a second plating layer on a conductive film 50. The plating system includes a plating tank, and a conductive plating apparatus configured to communicate the conductive film 50 with a negative electrode of a power supply.

Please continue to refer to the FIGURE, a tank 10 is a basis for arranging other structures, and includes a first plating tank 11, a first liquid separation tank 12, a first liquid recycling tank 13, a second liquid separation tank 14, a conductive liquid tank 15, a third liquid separation tank 16, a second liquid recycling tank 17, a fourth liquid separation tank 18, and a second plating tank 19 that are arranged sequentially. The first liquid separation tank 12, the first liquid recycling tank 13, and the second liquid separation tank 14 are formed as a first separation structure configured to separate the first plating tank 11 from the conductive liquid tank 15, and the third liquid separation tank 16, the second liquid recycling tank 17, and the fourth liquid separation tank 18 is formed as a second separation structure configured to separate the second plating tank 19 from the conductive liquid tank 15. Both the first plating tank 11 and the second plating tank 19 are filled with plating solution. During the plating process, metal ions in the plating solution are deposited on the first surface 51 and the second surface 52 of the conductive film 50, so that the conductive film is deposited. Conductive liquid is contained in the conductive liquid tank 15, and may be a dilute sulfuric acid, a dilute hydrochloric acid or the like. The present disclosure does not limit the conductive liquid, as long as a solution with a predetermined conductivity is within the scope of the present disclosure.

The first liquid separation tank 12 and the fourth liquid separation tank 18 are used to separate the plating solution to prevent the plating solution from entering the conductive liquid tank 15, and the second liquid separation tank 14 and the third liquid separation tank 16 are used to separate the conductive liquid to prevent the conductive liquid from entering the plating tank. Further, the first liquid recycling tank 13 is arranged between the first liquid separation tank 12 and the second liquid separation tank 14, and the second liquid recycling tank 17 is arranged between the third liquid separation tank 16 and the fourth liquid separation tank 18, so as to avoid mutual contamination between the plating solution and the conductive liquid.

In the embodiment of the present disclosure, in order to confine the plating solution in the first plating tank 11 and the second plating tank 19, a set of first liquid stopping rollers 61 is arranged at an interface between the first plating tank 11 and the first liquid separation tank 12, and includes two first liquid stopping rollers 61 that are arranged up and down to confine the plating solution in the first plating tank 11. Correspondingly, a set of second liquid stopping rollers 62 is arranged at an interface between the second plating tank 19 and the fourth liquid separation tank 18, and includes two second liquid stopping rollers 62 that are arranged up and down to confine the plating solution in the second plating tank 19. In some embodiments, the first plating tank 11 and the second plating tank 19 may be in communication with each other. That is, the plating solution contained in the first plating tank 11 and the plating solution contained in the second plating tank 19 may circulate to each other.

Further, in order to confine the conductive liquid in the conductive liquid tank 15, a set of third liquid stopping rollers 63 is arranged at an interface between the conductive liquid tank 15 and the second liquid separation tank 14, and includes two third liquid stopping rollers 63 that are arranged up and down. In addition, a set of fourth liquid stopping rollers 64 is also arranged at an interface between the conductive liquid tank 15 and the third liquid separation tank 16, and includes two fourth liquid stopping rollers 64 that are arranged up and down. The conductive liquid can be confined in the conductive liquid tank 15 by a cooperation between the third liquid stopping roller 63 and the fourth liquid stopping roller 64

Further, a set of first liquid pressing rollers 65 is arranged in the first liquid recycling tank 13, the set of first liquid pressing rollers 65 includes two first liquid pressing rollers 65 that are arranged up and down. In addition, a set of second liquid pressing rollers 66 is arranged in the secondary liquid recycling tank 17, and includes two second liquid pressing rollers 66 that are arranged up and down. Through the arrangement of the first liquid pressing roller 65 and the second liquid pressing roller 66, the conductive liquid on the conductive film 50 or the plating solution on the conductive film 50 can be removed, so as to avoid the conductive film 50 from being contaminated by the conductive liquid after entering the plating solution, or avoid the conductive film 50 from being contaminated by the plating solution when in contact with the conductive liquid.

In other embodiments, the first liquid recycling tank 13 and the second liquid recycling tank 17 may not be provided, and correspondingly, the first liquid pressing roller 65 and the second liquid pressing roller 66 may not be provided, and the conductive liquid and the plating solution are separated by the liquid separation tank.

In the embodiment of the present disclosure, the conductive plating apparatus includes a first conductive structure 20, a second conductive structure 30, and a spray device 40. The first conductive structure 20, the second conductive structure 30, and the spray device are all located in the conductive liquid tank 15. The spray device 40 is configured to spray the conductive liquid in the conductive liquid tank 15. When mounting the conductive film 50, the conductive film 50 first enters the plating solution of the first plating tank 11, passes between the two first liquid stopping rollers 61, then between the two first liquid pressing rollers 65, then between the two third liquid stopping rollers 63, and then is mounted on the first conductive structure 20 and the second conductive structure 30. Thereafter, the conductive film 50 passes between the two fourth liquid stopping rollers 64, then between the two second liquid pressing rollers 66, then between the two second liquid stopping rollers 62, and then enters the plating solution in the second plating tank 19, so as to realize the mounting of the conductive film 50.

In order to reduce or even eliminate a potential difference between the first surface 51 and the second surface 52 of the conductive film 50, in the embodiment of the present disclosure, the first conductive structure 20 includes a first conductive roller 21 and a first press roller 22. The second conductive structure 30 includes a second conductive roller 31 and a second press roller 32. The first conductive structure 20 and the second conductive structure 30 are configured to allow the conductive film 50 to sequentially pass between the first conductive roller 21 and the first press roller 22 and between the second conductive roller 31 and the second press roller 32. The first press roller 22 and the second press roller 32 are configured to be brought into contact with and apply a pressure to two opposite surfaces of the conductive film 50, respectively. In addition, the first press roller 22 and the second conductive roller 31 are configured to be equipotential, and the second press roller 32 and the first conductive roller 21 are configured to be equipotential.

When mounting the conductive film 50, the conductive film 50 is controlled to pass between the first conductive roller 21 and the first press roller 22 and between the second conductive roller 31 and the second press roller 32. The first conductive roller 21 and the second conductive roller 31 are connected to the negative electrodes of the power supply, respectively. The first conductive roller 21 is brought into contact with and energizes the second surface 52 of the conductive film 50. The second conductive roller 31 is brought into contact with and energizes the first surface 51 of the conductive film 50. In addition, since the second conductive roller 31 and the first press roller 22 are equipotential, and the first conductive roller 21 and the second press roller 32 are equipotential, potentials between a position where the first surface 51 of the conductive film 50 is brought into contact with the first press roller 22 and a position where the second surface 52 of the conductive film 50 is brought into contact with the first conductive roller 21 are substantially equal to each other, and potentials between a position where the first surface 51 of the conductive film 50 is brought into contact with the second conductive roller 31 and a position where the second surface 52 of the conductive film 50 is brought into contact with the second press roller 32 are substantially equal to each other, which may reduce the potential difference between the first surface 51 and the second surface 52 of the conductive film 50, thereby avoiding the conductive film 50 from being penetrated during the plating process, and thus a better plating effect can be provided for the conductive film 50.

Further, the first conductive roller 21 and the second press roller 32 are electrically connected to each other, and the second conductive roller 31 and the first press roller 22 are electrically connected to each other. In some embodiments, wires may be connected externally. Thus, the first conductive roller 21 and the second press roller 32 may be electrically connected to each other by the wires, and the second conductive roller 31 and the first press roller 22 may be electrically connected to each other by the wire. Thus, it is possible to realize an electrical connection between the conductive rollers and the press rollers.

Through the electrical connection by means of the wires, the first conductive roller 21 and the second press roller 32 are equipotential, and the second conductive roller 31 and the first press roller 22 are equipotential, thereby reducing the potential difference between the first surface 51 and the second surface 52 of the conductive film 50.

Further, each of the first conductive roller 21 and the second conductive roller 31 is a rigid roller. The first press roller 22 is configured to be in contact with the first surface 51 of the conductive film 50 and apply a pressure to the first conductive roller 21, so that the conductive film 50 is pressured by the first press roller 22 and the first conductive roller 21. The second press roller 32 is configured to be in contact with the second surface 52 of the conductive film 50 and apply pressure to the second conductive roller 31, so that the conductive film 50 is pressed by the second press roller 32 and the second conductive roller 31.

The first press roller 22 and the first conductive roller 21 are brought into contact with two opposite surfaces at a first position of the conductive film 50 and is pressed against each other, respectively, and the second press roller 32 and the second conductive roller 31 are also bought into contact with two opposite surfaces at a second position of the conductive film 50 and is pressed against each other, respectively. Through the first press roller 22 and the second press roller 32, the conductive film 50 is brought into better contact with the first conductive roller 21 and the second conductive roller 31, so that a better conductive effect can be provided between the conductive roller and the conductive film 50, which can improve an overcurrent capability between the conductive film 50 and the conductive rollers, and reduce the resistance, thereby reducing a heat generation, so as to reduce the possibility of the penetration of the conductive film 50.

The first conductive roller 21 and the second conductive roller 31 are configured to in such a manner that the conductive film has an angle of contact when the conductive film 50 is delivered, and the angle of contact is formed to increase a contact area between the first conductive roller 21 and the second surface 52 of the conductive film 50, and a contact area between the second conductive roller 31 and the first surface 51 of the conductive film 50, to a certain extent, which can provide better conductive effect between the conductive film 50 and the conductive roller to reduce the possibility of the penetration of the conductive film 50.

The first press roller 22 is located at a middle of the angle of contact on the first conductive roller 21, and the second press roller 32 is located at a middle of the angle of contact on the second conductive roller 31. When the press rollers exerts a force on the conductive film 50, better contact effect and better conductive effect can be provided between the conductive film 50 and the conductive rollers. The first conductive roller 22 has a predetermined radian at the angle of contact, and the middle at the angle of contact refers to the approximately middle position at the angle of contact, rather than the exactly middle position at the angle of contact.

Further, an outer diameter of the first conductive roller 21 is greater than an outer diameter of the first press roller 22, and an outer diameter of the second conductive roller 31 is greater than an outer diameter of the second press roller 32. The first conductive roller 21 and the second conductive roller 31 are configured to be formed with an angle of contact ranging from 60° to 90° when delivering the conductive film 50. Since each of the first conductive roller 21 and the second conductive roller 31 has the relatively large outer diameter, when the angle of contact ranging from 60° to 90° is formed, the contact area between the conductive film 50 and the conductive roller is relatively large, and the contact effect is better, so as to conduct electricity between the conductive film 50 and the conductive roller. In some embodiments of the present disclosure, both an axis of the first conductive roller 21 and an axis of the second conductive roller 31 are arranged substantially horizontally. After the first conductive roller 21 and the second conductive roller 31 are mounted, the first conductive roller 21 and the second conductive roller 31 are arranged horizontally to guide the conductive film 50. In the embodiment of the present disclosure, the axis of the first conductive roller 21 is lower than the axis of the second conductive roller 31. That is, after the first conductive roller 21 and the second conductive roller 31 are mounted, an axis center of the first conductive roller 21 is lower than that of the second conductive roller 31, and the first conductive roller 21 and the second conductive roller 31 are staggered in such a manner that one roller is located above the other roller with one roller located at a left side and the other roller located at a right side (as shown in the FIGURE). In a case where the diameters of the first conductive roller 21 and the second conductive roller 31 do not need to be too large, the angle of contact of each of the first conductive roller 21 and the second conductive roller 31 can also be effectively increased to increase the conductive effect between the conductive film 50 and the conductive rollers.

Further, the first press roller 22 is located above the first conductive roller 21, and the second press roller 32 is located below the second conductive roller 31. After the first conductive roller 21 and the second conductive roller 31 is mounted, the first conductive roller 21 is partially immersed in the conductive liquid. Since the first conductive roller 21 is continuously rotated during a movement of the conductive film 50, a lower part of the first conductive roller 21 in contact with the conductive liquid is rotated to be located above the first conductive roller 21 (an upper side of the first conductive roller 21 in contact with the conductive film 50). When the conductive film 50 is brought into contact with the first conductive roller 21, there is a predetermined amount of conductive liquid between the conductive film 50 and the first conductive roller 21, which can provide better conductive effect between the conductive film 50 and the conductive rollers, and can also lower a temperature of the conductive roller, so as to cool the conductive film 50 in contact with the conductive rollers.

In other embodiments, the axis of the first conductive roller 21 is higher than the axis of the second conductive roller 31. That is, after the first conductive roller 21 and the second conductive roller 31 are mounted, an axis center of the first conductive roller 21 is higher than an axis center of the second conductive roller 31, and the first conductive roller 21 and the second conductive roller 31 are staggered in such a manner that one roller is located above the other roller with one roller located at a left side and the other roller located at a right side.

In the embodiment of the present disclosure, each of the first press roller 22 and the second press roller 32 has a same length as a width of the conductive film 50, so that a uniform pressure can be provided in a width direction of the first surface 51 of the conductive film 50 and a width direction of the second surface 52 of the conductive film 50, so that better contact effect of the conductive film 50 and the conductive rollers can be provided, and the temperature of the conductive rollers can also be lowered, so as to cool the conductive film 50 in contact with the conductive roller.

In other embodiments, each of the first press roller 22 and the second press roller 32 has a length smaller than the width of the conductive film 50, which can reduce the length of the press rollers and can also apply a predetermined pressure to the conductive film 50. In the present disclosure, the length of the press roller is not limited, as long as the press roller may achieve the equipotential effect and apply a predetermined pressure to the conductive film 50, which is within the scope of the present disclosure.

In the embodiment of the present disclosure, both the first press roller 22 and the second press roller 32 are electrically conductive. In some embodiments of the present disclosure, each of the first press roller 22 and the second press roller 32 is a rubber roller. Each of the first press roller 22 and the second press roller 32 is hard on the inside and soft on the outside, and has a surface made of a conductive rubber having a predetermined deformation capability. When the conductive film 50 is rolled by the rubber roller, the surface of the rubber roller may have a concave-convex structure to match a small number of uneven parts on the surface of the conductive film 50, so that a pressure at any position of the conductive film 50 is substantially the same, so that better contact effect can be provided between the conductive film 50 and the conductive roller, which can prevent the conductive film from being penetrated due to excessively heated, and can also reduce the possibility of wrinkling of the conductive film 50.

In other embodiments, the surface of each of the first press roller 22 and the second press roller 32 may also be other deformable soft materials, rather than deformable conductive rubber, which are not limited in the embodiments of the present disclosure. The materials are all fall within the scope of the present disclosure, as long as they have a predetermined plastic deformation capability and a predetermined electrical conductivity.

In the embodiment of the present disclosure, in order to improve the electrical conductivity between the conductive film 50 and the conductive roller, and to further reduce the potential difference between the first surface 51 and the second surface 52 of the conductive film 50. The spray device 40 is used to spray the conductive liquid contained in the conductive liquid tank 15 onto the conductive film 50 that is being delivered or/and the conductive roller that is rotating. The electricity can be conducted through the conductive liquid at a position where the contact effect between the conductive film 50 and the conductive roller is poor, so that better conductive effect can be provided between the conductive film 50 and the conductive roller. Thus, the overcurrent capability between the conductive film and the conductive roller is stronger, thereby preventing the conductive film from being penetrated due to being overheated. Meanwhile, since the conductive liquid has a predetermined cooling effect, the heated conductive film can be effectively cool downs to prevent the conductive film from being penetrated due to being heated.

In some embodiments of the present disclosure, the spray device 40 includes a first spray device 41 and a second spray device 42. The first spray device 41 is configured to spray the conductive liquid in the conductive liquid tank 15 into a gap formed between the conductive film 50 that is being delivered and the first conductive roller 21, and the second spray device 42 is configured to spray the conductive liquid into a gap formed between the conductive film 50 that is being delivered and the second conductive roller 31.

By spraying the conductive liquid into the gap formed by the conductive film 50 and the first conductive roller 21 by the first spray device 41, and spraying the conductive liquid into the gap formed by the conductive film 50 and the second conductive roller 31 by the second spray device 42, the conductive liquid can be sprayed onto the surface of the conductive film 50 in contact with the conductive rollers and at the position where the conductive rollers are in contact with the conductive film 50. When the conductive film 50 is brought into contact with the conductive rollers, the gap between the conductive film 50 and the conductive roller may be filled with the conductive liquid. The conductive liquid can be filled to the position where the conductive film 50 is in contact with the conductive roller and the conductive effect is not good (the gap between the conductive film 50 and the conductive roller), so as to improve the overall conductive effect between the conductive film 50 and the conductive roller, and the cooling effect is also better, thereby reducing the problem of the penetration of the conductive film.

In some embodiments of the present disclosure, the conductive liquid tank 15 is located directly below the spray device 40, and the conductive liquid sprayed onto the conductive film 50 or the conductive roller directly flows into the conductive liquid tank 15 for recovery and recycle of the conductive liquid.

Further, the first conductive structure 20 and the second conductive structure 30 are arranged sequentially in a delivering direction of the conductive film 50. The first spray device 41 is located upstream of the first conductive roller 21, and the second spray device 42 is located downstream of the first conductive roller 21 and upstream of the second conductive roller 31. After being sprayed first, the conductive film 50 is brought into contact with the conductive roller, so that the effect of the conductive liquid is better, to allow better conductive effect between the conductive film 50 and the conductive roller. Further, it is possible to cool the conductive film first, and then bring the conductive film into contact with the press rollers and the conductive rollers to prevent the conductive film from being penetrated due to excessive temperature under the interaction force of the press roller and the conductive roller.

Further, the conductive liquid has a temperature lower than a plating temperature for the conductive film 50 by 5° C. to 10° C. After the conductive liquid is sprayed onto the conductive film 50 or/and the conductive roller, the conductive film 50 and the conductive rollers can be cooled. That is, the contact surface between the conductive film 50 and the conductive rollers can be cooled to improve the overcurrent capability from the conductive roller to the conductive film 50.

In some possible implementations, the temperature of the conductive liquid is lower than the plating temperature of the conductive film 50 by 5° C., 6° C., 8° C. or 10° C.

In other embodiments, the spray device 40 may not be provided to spray the conductive liquid. By setting the first press roller 22 and the second conductive roller 31 equipotential, and setting the second press roller 32 and the first conductive roller 21 equipotential, it is possible to reduce the potential difference between the first surface 51 and the second surface 52 of the conductive film 50 to a certain extent, which is within the scope of the present disclosure.

The operating principle of the plating system according to the embodiment of the present disclosure will be described below.

Mounting the conductive film 50: the conductive film 50 is unwound around the unwinding roller, and then enters the plating solution in the first plating tank 11. Thereafter, the conductive film 50 sequentially passes between the two first liquid stopping rollers 61, between the two first liquid pressing rollers 65, between the two third liquid stopping rollers 63, between the first press roller 22 and the first conductive roller 21, between the second press roller 32 and the second conductive roller 31, between the two fourth liquid stopping rollers 64, between the two second liquid pressing rollers 66, and between the two second liquid stopping rollers 62, then enters the plating solution in the second plating tank 19, and is wound around a winding roller, so as to realize the mounting of the conductive film 50.

Plating: the plating solutions in the first plating tank 11 and the second plating tank 19 are connected to the positive electrodes of the power supply (the plating solution in the first plating tank 11 and the plating solution in the second plating tank 19 are in communication with each other), and the first conductive roller 21 and the second conductive roller 31 are connected to the negative electrodes of the power supply, so that a passageway is formed on the conductive film 50. By applying a predetermined current and voltage to the conductive film 50, metal ions in the plating solution may be deposited on the first surface 51 and the second surface 52 of the conductive film 50. Meanwhile, by setting the first press roller 22 and the second conductive roller 31 equipotential, and setting the second press roller 32 and the first conductive roller 21 equipotential, the potential difference between the first surface 51 and the second surface 52 of the conductive film 50 can be reduced or even eliminated to prevent the conductive film 50 from being penetrated during the plating process. Meanwhile, during the plating process, the conductive liquid is sprayed onto the conductive film 50 or/and the conductive rollers by the spray device 40, so that better conductive effect is provided between the conductive film 50 and the conductive roller, and the heat generation of the conductive film 50 can be reduced. Further, it is possible to improve heat dissipation effect of the conductive film, and prevent the conductive film 50 from being penetrated.

The above description is only a part of the embodiments of the present disclosure, rather than being intended to limit the present disclosure. For those skilled in the art, the present disclosure may have various modifications and changes. Any modification, equivalent replacement, improvement, etc. made within the spirit and principle of the present disclosure shall be included within the scope of the present disclosure.

INDUSTRIAL APPLICABILITY

In the present disclosure, by setting the first press roller and the second conductive roller equipotential, and setting the second press roller and the first conductive roller equipotential, the potentials between the position where the first surface of the conductive film is in contact with the first press roller and the position where the second surface of the conductive film is in contact with the first conductive roller are substantially equal, and the potentials between the position where the first surface of the conductive film is in contact with the second conductive roller and the position where the second surface of the conductive film is in contact with the second press roller are substantially equal, which can reduce the potential difference between the first surface and the second surface of the conductive film, thereby preventing the conductive film from being penetrated during the plating process, and providing better plating effect of the conductive film. The present disclosure effectively solves the problem that the substrate film is penetrated during the electroplating process, and is conducive to further preparation of electroplated products having a thinner substrate film and a thicker electroplated metal layer, which better meets the requirements of industrial applications, and has very good industrial application prospects.

What is claimed is:

1. A plating system, configured to form a first plating layer and a second plating layer on a conductive film, the plating system comprising:

a conductive plating apparatus configured to electrically connect the conductive film with a power supply, the conductive plating apparatus comprising:

a first conductive structure comprising a first conductive roller and a first press roller; and a second conductive structure comprising a second conductive roller and a second press roller; and a first plating tank and a second plating tank configured to contain plating solution, wherein the first conductive structure and the second conductive structure are configured to allow the conductive film to sequentially pass between the first conductive roller and the first press roller and between the second conductive roller and the second press roller;

wherein the first press roller and the second press roller are configured to be brought into contact with and apply pressures to two opposite surfaces of the conductive film respectively;

wherein the first press roller and the second conductive roller are configured to be equipotential;

wherein the second press roller and the first conductive roller are configured to be equipotential;

wherein the conductive plating apparatus is arranged outside the first plating tank and the second plating tank; and wherein the first plating tank being located at a side of the first conductive structure away from the second conductive structure, and the second plating tank being located at a side of the second conductive structure away from the first conductive structure, optionally, the first plating tank is in communication with the second plating tank, the plating system further comprises: a first separation structure for separating the first plating tank from a conductive liquid tank configured to contain conductive liquid, and a second separation structure for separating the second plating tank from the conductive liquid tank, wherein the first separation structure comprises a first liquid separation tank and a second liquid separation tank that are both located between the first plating tank and the conductive liquid tank, the first liquid separation tank being close to the first plating tank: and wherein the second separation structure comprises a third liquid separation tank and a fourth liquid separation tank that are both located between the second plating tank and the conductive liquid tank, the fourth liquid separation tank being close to the second plating tank.

2. The plating system according to claim 1, further comprising:

a first liquid recycling tank located between the first liquid separation tank and the second liquid separation tank; and a second liquid recycling tank located between the third liquid separation tank and the fourth liquid separation tank.

3. The plating system according to claim 2, wherein:

a set of first liquid stopping rollers is arranged at an interface between the first plating tank and the first liquid separation tank;

a set of second liquid stopping rollers is arranged at an interface between the second plating tank and the fourth liquid separation tank;

a set of third liquid stopping rollers is arranged at an interface between the conductive liquid tank and the second liquid separation tank;

a set of fourth liquid stopping rollers is arranged at an interface between the conductive liquid tank and the third liquid separation tank;

a set of first liquid pressing rollers is arranged in the first liquid recycling tank; and a set of second liquid pressing rollers is arranged in the second liquid recycling tank.

4. The plating system according to claim 1, wherein the first conductive roller and the second press roller are electrically connected to each other; and the second conductive roller and the first press roller are electrically connected to each other, optionally, the first conductive roller and the second press roller are electrically connected to each other by a wire, and the second conductive roller and the first press roller are electrically connected to each other by a wire.

5. The plating system according to claim 1, wherein:

the first press roller is configured to be brought into contact with a first surface of the conductive film and apply a pressure to the first conductive roller, in such a manner that the first press roller and the first conductive roller are pressed against the conductive film; and the second press roller is configured to be brought into contact with a second surface of the conductive film and apply a pressure to the second conductive roller, in such a manner that the second press roller and the second conductive roller are pressed against the conductive film.

6. The plating system according to claim 5, wherein the first conductive roller and the second conductive roller are configured in such a manner that the conductive film has an angle of contact when the conductive film is delivered.

7. The plating system according to claim 6, wherein:

the first press roller is located at a middle of the angle of contact on the first conductive roller; and the second press roller is located at a middle of the angle of contact on the second conductive roller.

8. The plating system according to claim 1, wherein each of the first press roller and the second press roller is a rubber roller.

9. The plating system according to claim 1, further comprising a spray device configured to spray conductive liquid to the conductive film that is being delivered or/and the conductive roller that is rotating, in such a manner that the conductive film and the respective conductive roller are capable of being electrically conductive by the sprayed conductive liquid.

10. The plating system according to claim 9, wherein the spray device comprise a first spray device and a second spray device, the first spray device being configured to spray the conductive liquid into a gap formed between the conductive film and the first conductive roller, and the second spray device being configured to spray the conductive liquid into a gap formed between the conductive film and the second conductive roller.

11. The plating system according to claim 10, wherein:

the first conductive structure and the second conductive structure are arranged sequentially in a delivering direction of the conductive film;

the first spray device is located upstream of the first conductive roller; and the second spray device is located downstream of the first conductive roller and upstream of the second conductive roller.

12. The plating system according to claim 9, further comprising a conductive liquid tank configured to contain the conductive liquid, wherein the first conductive structure, the second conductive structure, and the spray device are all located in the conductive liquid tank;

optionally, both an axis of the first conductive roller and an axis of the second conductive roller are arranged horizontally, the axis of the first conductive roller being lower than the axis of the second conductive roller, and the first conductive roller is at least partially immersed in the conductive liquid; or optionally, the axis of the first conductive roller is higher than the axis of the second conductive roller, and the second conductive roller is at least partially immersed in the conductive liquid.

* * * * *